US008928648B2

(12) United States Patent
Jin et al.

(10) Patent No.: US 8,928,648 B2
(45) Date of Patent: Jan. 6, 2015

(54) SCAN DRIVING DEVICE, METHOD FOR DRIVING SCAN DRIVING DEVICE, AND METHOD FOR MANAGING DEFECT OF SCAN DRIVING DEVICE

(75) Inventors: Guang hai Jin, Yongin (KR); Jae-Beom Choi, Yongin (KR); Kwan-Wook Jung, Yongin (KR); June-Woo Lee, Yongin (KR); Se-Hun Park, Yongin (KR); Moo-Jin Kim, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 306 days.

(21) Appl. No.: 13/465,821

(22) Filed: May 7, 2012

(65) Prior Publication Data

US 2013/0127808 A1 May 23, 2013

(30) Foreign Application Priority Data

Nov. 18, 2011 (KR) ..... 10-2011-0120910

(51) Int. Cl.

| | |
|---|---|
| ***G09G 5/00*** | (2006.01) |
| ***G09G 3/32*** | (2006.01) |
| ***G09G 3/36*** | (2006.01) |

(52) U.S. Cl.

CPC ..... *G09G 3/3266* (2013.01); *G09G 3/3674* (2013.01); *G09G 2310/0267* (2013.01); *G09G 2330/08* (2013.01)

USPC ..... 345/211

(58) Field of Classification Search

CPC ..... G09G 2320/02–2320/0295; G09G 2320/04–2320/048; G09G 2310/02–2310/024; G09G 3/20; G09G 3/006; G09G 2310/0267; G02F 1/13454; G02F 2001/136254

See application file for complete search history.

(56) References Cited

U.S. PATENT DOCUMENTS

2005/0078057 A1 * 4/2005 Chang et al. ..... 345/55

FOREIGN PATENT DOCUMENTS

| | | |
|---|---|---|
| JP | 2007-114761 | 5/2007 |
| JP | 2011-33846 | 2/2011 |
| KR | 10-2010-0005302 | 1/2010 |

* cited by examiner

*Primary Examiner* — Tony N Ngo

(74) *Attorney, Agent, or Firm* — Robert E. Bushnell, Esq.

(57) ABSTRACT

A scan driving device includes: a first scan driving block group including scan driving blocks receiving at least two different clock signals among a plurality of scan driving blocks which are sequentially arranged; a second scan driving block group including scan driving blocks receiving at least two clock signals which are the same as at least two clock signals inputted to each of the scan driving blocks included in the first scan driving block group; first line transistors connected in parallel to scan lines of each of the scan driving blocks included in the first scan driving block group, and turned on or off according to a first line connection signal; and second line transistors connected in parallel to a scan line of each of the scan driving blocks included in the second scan driving block group and turned on or off according to a second line connection signal.

18 Claims, 10 Drawing Sheets

SCAN DRIVING DEVICE, METHOD FOR DRIVING SCAN DRIVING DEVICE, AND METHOD FOR MANAGING DEFECT OF SCAN DRIVING DEVICE

CLAIM OF PRIORITY

This application makes reference to, incorporates the same herein, and claims all benefits accruing under 35 U.S.C. §119 from an application earlier filed in the Korean Intellectual Property Office on the 18 Nov. 2011 and there duly assigned Serial No. 10-2011-0120910.

BACKGROUND OF THE INVENTION

1. Field of the Invention

The present invention relates to a scan driving device, a method for driving a scan driving device, and a method for managing a defect of a scan driving device, and more particularly, the present invention relates to a scan driving device including a plurality of scan driving blocks, in which the scan driving device can manage a defect that occurs in some scan driving blocks, a method for driving a scan driving device, and a method for managing a defect of a scan driving device.

2. Description of the Related Art

A display device sequentially applies scan signals having a gate-on voltage to a plurality of scan lines and applies data signals corresponding to the scan signal having a gate-on voltage to a plurality of data lines in order to display an image.

A scan driving device has a structure in which a plurality of scan driving blocks are arranged in sequence so as to sequentially output scan signals having a gate-on voltage. The plurality of scan driving blocks may sequentially output scan signals having a gate-on voltage in a manner in which a next scan driving block receives a scan signal of a scan driving block arranged ahead so as to generate a scan signal.

If any one of the plurality of scan driving blocks fails or a defect thereof occurs in a production process, a line defect arises, which leads to a defect in the entire scan driving device. It is realistically difficult to replace only the defective scan driving block, and thus a scan driving device including the defective scan driving block is destroyed.

The above information disclosed in this Background section is only for enhancement of an understanding of the background of the invention, and therefore it may contain information that does not form the prior art that is already known in this country to a person of ordinary skill in the art.

SUMMARY OF THE INVENTION

The present invention has been developed in an effort to provide a scan driving device having the advantage of managing defects which occur in some scan driving blocks among a plurality of scan driving blocks, a method for driving a scan driving device, and a method for managing a defect of a scan driving device.

An exemplary embodiment of the present invention provides a scan driving device which comprises: a first scan driving block group including a plurality of scan driving blocks receiving at least two different clock signals among a plurality of scan driving blocks which are sequentially arranged; a second scan driving block group including a plurality of scan driving blocks receiving at least two clock signals which are the same as at least two clock signals inputted to each of the plurality of scan driving blocks included in the first scan driving block group; a plurality of first line transistors which are connected in parallel to scan lines of each of the plurality of scan driving blocks included in the first scan driving block group, and which are turned on or off according to a first line connection signal; and a plurality of second line transistors which are connected in parallel to scan lines of each of the plurality of scan driving blocks included in the second scan driving block group, and which are turned on or off according to a second line connection signal.

A scan line of a first defective scan driving block among the plurality of scan driving blocks included in the first scan driving block group may be disconnected, and a scan signal of the first scan driving block may be outputted through a first line transistor connected in parallel to the disconnected scan line.

Each of the plurality of scan driving blocks which are sequentially arranged may include an input terminal for receiving a scan signal of the scan driving block arranged ahead. An input terminal of the first scan driving block may be connected to an input terminal of the second scan driving block having the same input pattern of clock signals as the first scan driving block among the plurality of scan driving blocks included in the second scan driving block group. An output terminal of the second scan driving block may be connected to an output terminal of the first scan driving block.

The second scan driving block may be a scan driving block for outputting a scan signal after the first scan driving block.

The first line connection signal may be applied at a gate-off voltage which turns off the plurality of the first line transistors for a period of time when the plurality of scan driving blocks included in the second scan driving block group output scan signals having a gate-on voltage.

The first line connection signal may be applied at a gate-on voltage which turns on the plurality of the first line transistors for a period of time when the plurality of scan driving blocks included in the first scan driving block group output scan signals having a gate-on voltage.

The second line connection signal may be applied at a gate-off voltage which turns off the plurality of the second line transistors for a period of time when the plurality of scan driving blocks included in the first scan driving block group output scan signals having a gate-on voltage.

The second line connection signal may be applied at a gate-on voltage which turns on the plurality of the second line transistors for a period of time when the plurality of scan driving blocks included in the second scan driving block group output scan signals having a gate-on voltage.

The number of scan driving blocks included in the first scan driving block group may be proportional to the number of the clock signals.

The number of scan driving blocks included in the second scan driving block group may be the same as the number of scan driving blocks included in the first scan driving block group.

Another exemplary embodiment of the present invention provides a method for driving a scan driving device, including a first scan driving block group which includes a plurality of scan driving blocks receiving at least two different clock signals among a plurality of scan driving blocks which are sequentially arranged, and a second scan driving block group which includes a plurality of scan driving blocks receiving at least two clock signals which are the same as at least two clock signals inputted to each of the plurality of scan driving blocks included in the first scan driving block group. The method comprises: applying a signal, inputted to an input terminal of a first defective scan driving block among the plurality of scan driving blocks included in the first scan driving block group, to an input terminal of a second scan driving block having the same input pattern of clock signals as the first scan driving block among the plurality of scan driving blocks included in the second scan driving block group; applying a scan signal of the second scan driving block to a scan line of the first scan driving block; and applying the scan signal of the second scan driving block to a scan line of the second scan driving block as a scan signal of a scan driving block, arranged ahead of the second scan driving block is applied to an input terminal of the second scan driving block.

The signal inputted to the input terminal of the first scan driving block may be any one of a scan start signal and a scan signal of a scan driving block arranged ahead of the first scan driving block.

The applying of the scan signal of the second scan driving block to the scan line of the first scan driving block may include: disconnecting the scan line of the first scan driving block and turning on a line transistor connected to both ends of the disconnected scan line; and applying the scan signal of the second scan driving block to the scan line of the first scan driving block through the turned-on line transistor.

The applying of the scan signal of the second scan driving block to the scan line of the second scan driving block may include turning off the line transistor.

Yet another exemplary embodiment of the present invention provides a method for managing a defect of a scan driving device, including a first scan driving block group which includes a plurality of scan driving blocks receiving at least two different clock signals among a plurality of scan driving blocks which are sequentially arranged, and a second scan driving block group including a plurality of scan driving blocks receiving at least two clock signals which are the same as at least two clock signals inputted to each of the plurality of scan driving blocks included in the first scan driving block group. The method comprises: connecting an input terminal of a first defective scan driving block, among the plurality of scan driving blocks included in the first scan driving block group, to an input terminal of a second scan driving block having the same input pattern of clock signals as the first scan driving block among the plurality of scan driving blocks included in the second scan driving block group; connecting an output terminal of the second scan driving block to an output terminal of the first scan driving block; and disconnecting a scan line of the first scan driving block and connecting both ends of the disconnected scan line to both ends of a line transistor.

The method for managing a defect of a scan driving device may further include connecting a gate electrode of the line transistor to a line connection signal line transmitting a line connection signal applied at a gate-off voltage for a period of time when the plurality of scan driving blocks included in the second scan driving block group output scan signals having a gate-on voltage.

The line connection signal may be applied at a gate-on voltage turning on the line transistor for a period of time when the plurality of scan driving blocks included in the first scan driving block group output scan signals having a gate-on voltage.

The second scan driving block may be a scan driving block for outputting a scan signal after the first scan driving block.

According to the exemplary embodiments of the present invention, it is possible to manage the defect of the scan driving device including the plurality of scan driving blocks, and to improve a yield in a production process of the scan driving device.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
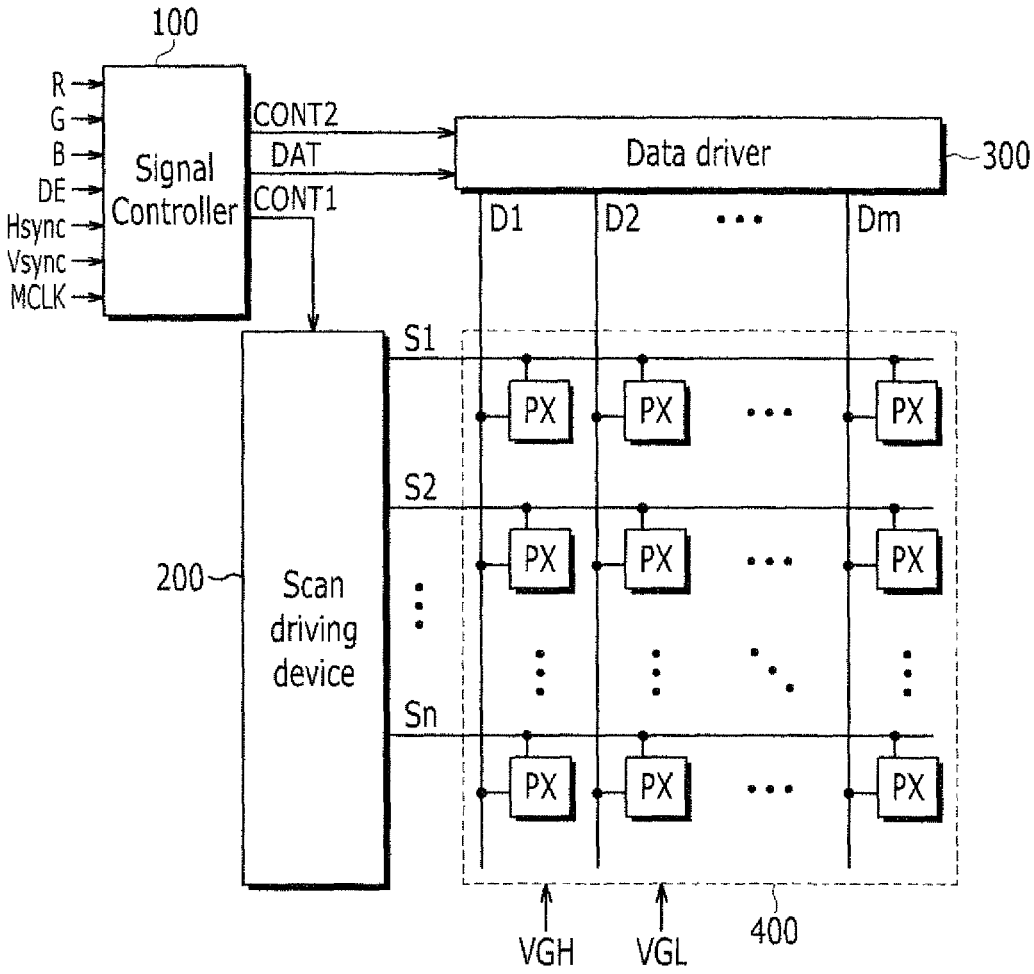
FIG. 1 is a block diagram showing a display device according to an exemplary embodiment of the present invention.

The present invention will be described more fully hereinafter with reference to the accompanying drawings, in which exemplary embodiments of the invention are shown. As those skilled in the art will realize, the described embodiments may be modified in various different ways, all without departing from the spirit or scope of the present invention.

Furthermore, in the embodiments, like reference numerals designate like elements throughout the specification representatively in a first embodiment, and only elements other than those of the first embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram showing a display device according to an exemplary embodiment of the present invention.

Referring to FIG. 1, a display device includes a signal controller 100, a scan driving device 200, a data driver 300, and a display unit 400.

The signal controller 100 receives video signals R, G, and B inputted from an external device and input control signals for controlling a display thereof. The video signals R, G, and B include luminance information on each pixel PX and luminance has a predetermined number of, for example, 1024 ($=2^{10}$), 256 ($=2^8$) or 64 ($=2^6$) grays. Examples of the input control signal include a vertical synchronization signal Vsync, a horizontal synchronization signal Hsync, a main clock signal MCLK, and a data enable signal DE.

The signal controller 100 appropriately processes the input video signals R, G, and B in accordance with an operating condition of the display unit 400 and the data driver 300 on the basis of the input video signals R, G, and B and the input control signals, and generates a scan control signal CONT1, a data control signal CONT2, and an image data signal DAT. The signal controller 100 transmits the scan control signal CONT1 to the scan driving device 200. The signal controller 100 transmits the data control signal CONT2 and the image data signal DAT to the data driver 300.

The display unit 400 includes a plurality of pixels PX which are connected to a plurality of scan lines $S_1$-$S_n$, to a plurality of data lines $D_1$-$D_m$, and to a plurality of signal lines $S_1$-$S_n$ and $D_1$-$D_m$ and arranged substantially in a matrix. The plurality of scan lines $S_1$-$S_n$ extend in a substantially row direction so as to be substantially parallel to each other. The plurality of data lines $D_1$-$D_m$ extend in a substantially column direction so as to be substantially parallel to each other. The plurality of pixels PX of the display unit 400 are supplied with first power source voltage VGH and second power source voltage VGL from the outside.

The scan driving device 200 is connected to the plurality of scan lines $S_1$-$S_n$, and applies to, the plurality of scan lines $S_1$-$S_n$, scan signals configured by a combination of gate-on voltage Von which turns on application of a data signal to the pixel PX and gate-off voltage Voff which turns off the application in accordance with the scan control signal CONT1.

The scan control signal CONT1 includes a scan start signal SSP, a clock signal SCLK, a line connection signal LRS, and the like. The scan start signal SSP is a signal generating a first scan signal for displaying an image of one frame. The clock signal SCLK is a synchronization signal for sequentially applying scan signals to the plurality of scan lines $S_1$-$S_n$ The line connection signal LRS is a signal for controlling the output of the scan signal in a scan driving block in which a defect occurs.

The data driver 300 is connected to the plurality of data lines $D_1$-$D_m$, and selects gray voltage according to the image data signals DAT. The data driver 300 applies the gray voltage selected in accordance with the data control signals CONT2, as a data signal, to the plurality of data lines D1-Dm.

Each of the drivers 100, 200, and 300 described above may be mounted outside a pixel area as at least one integrated circuit, mounted on a flexible printed circuit film, attached to the display unit 400, as a tape carrier package (TCP), mounted on a separate printed circuit board, or integrated outside the pixel area together with the signal lines $S_1$-$S_n$ and $D_1$-$D_m$.

Figure 2:
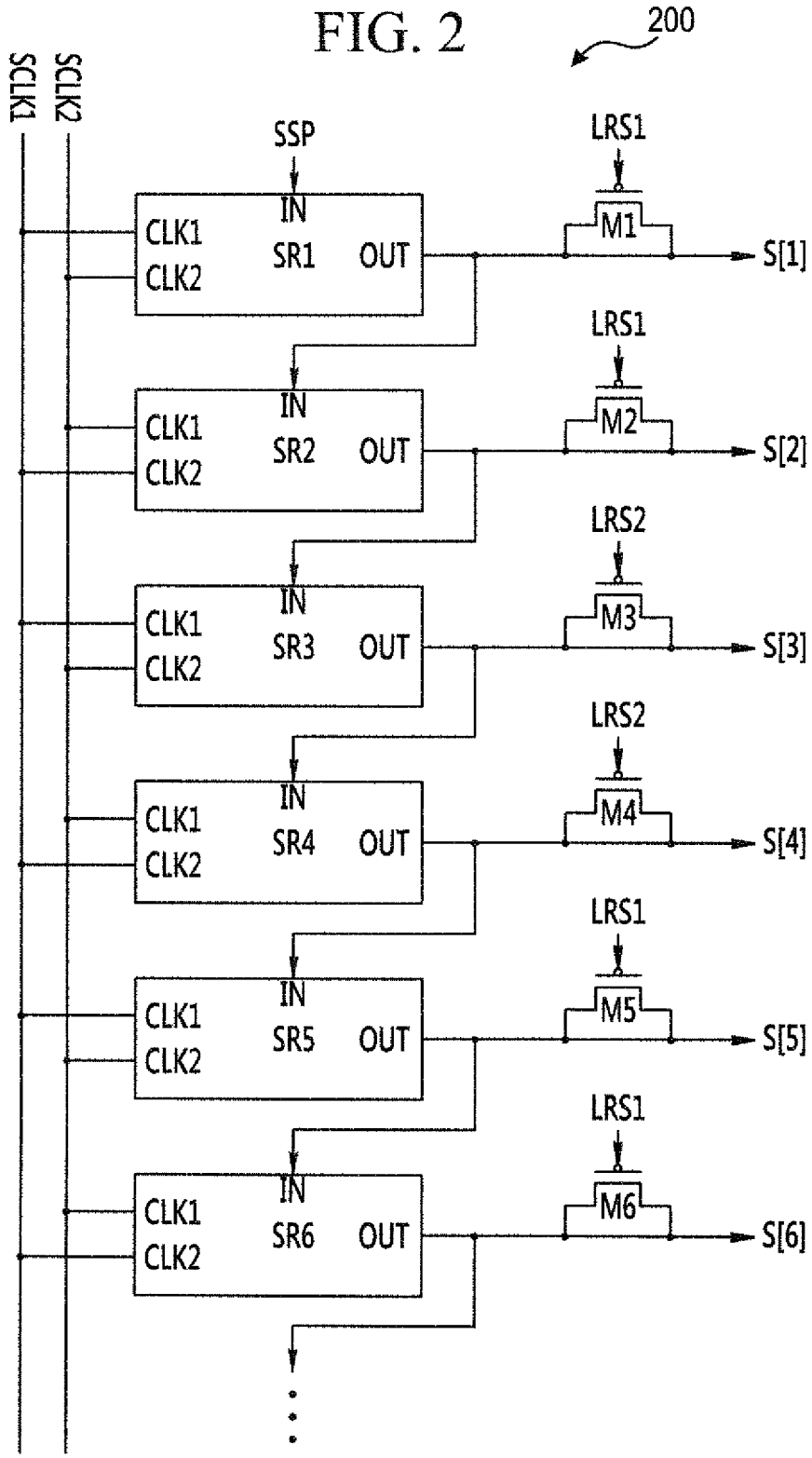
FIG. 2 is a block diagram showing the configuration of a scan driving device according to an exemplary embodiment of the present invention.

FIG. 2 is a block diagram showing the configuration of a scan driving device according to an exemplary embodiment of the present invention.

Referring to FIG. 2, the scan driving device 200 includes a plurality of scan driving blocks SR1, SR2, SR3, SR4, SR5, SR6, . . . which are sequentially arranged, and a plurality of line transistors M1, M2, M3, M4, M5, M6, . . . which are connected in parallel to scan lines of each of the plurality of scan driving blocks SR1, SR2, SR3, SR4, SR5, SR6, . . . .

Each of the plurality of scan driving blocks SR1, SR2, SR3, SR4, SR5, SR6, . . . includes a first clock signal input terminal CLK1, a second clock signal input terminal CLK2, an input signal input terminal IN, and an output terminal OUT.

A scan start signal SSP is applied to the input signal input terminal IN of a first scan driving block SR1 among the plurality of scan driving blocks SR1, SR2, SR3, SR4, SR5, SR6, . . . and scan signals of the scan driving blocks arranged ahead are applied to the input signal input terminals IN of the other scan driving blocks SR2, SR3, SR4, SR5, SR6, . . . .

Each of the scan driving blocks SR1, SR2, SR3, SR4, SR5, SR6, . . . outputs, to its output terminal OUT, the scan signals S[1], S[2], S[3], S[4], S[5], S[6], . . . generated according to a signal inputted into the first clock signal input terminal CLK1, the second clock signal input terminal CLK2, and the input signal input terminal IN.

A first clock signal SCLK1 is inputted to the first clock signal input terminals CLK1 of odd numbered scan driving blocks SR1, SR3, SR5, . . . among the plurality of scan driving blocks SR1, SR2, SR3, SR4, SR5, SR6, . . . and a second clock signal SCLK2 is inputted to the second clock signal input terminals CLK2 thereof.

The second clock signal SCLK2 is inputted to the first clock signal input terminals CLK1 of even numbered scan driving blocks SR2, SR4, SR6, . . . among the plurality of scan driving blocks SR1, SR2, SR3, SR4, SR5, SR6, . . . and the first clock signal SCLK1 is inputted to the second clock signal input terminals CLK2 thereof.

As described above, the odd numbered scan driving blocks SR1, SR3, SR5, . . . and the even numbered scan driving blocks SR2, SR4, SR6, . . . have different input patterns of the clock signals SCLK1 and SCLK2.

The plurality of scan driving blocks SR1, SR2, SR3, SR4, SR5, SR6, . . . which are sequentially arranged may be classified into a plurality of scan driving block groups including a plurality of scan driving blocks having different input patterns of the clock signals SCLK1 and SCLK2.

A first scan driving block group includes a first scan driving block SR1 and a second scan driving block SR2. That is, the first scan driving block group includes the odd numbered scan driving block SR1 and the even numbered scan driving block SR2 which have different input patterns of the clock signals SCLK1 and SCLK2.

A second scan driving block group includes a third scan driving block SR3 and a fourth scan driving block SR4. That is, the second scan driving block group includes the odd numbered scan driving block SR3 and the even numbered scan driving block SR4 which have different input patterns of the clock signals SCLK1 and SCLK2.

A third scan driving block group includes a fifth scan driving block SR5 and a sixth scan driving block SR6. That is, the third scan driving block group includes the odd numbered scan driving block SR5 and the even numbered scan driving block SR6 which have different input patterns of the clock signals SCLK1 and SCLK2.

The number of the plurality of scan driving blocks included in the scan driving block group may be proportional to the number of clock signals SCLK1 and SCLK2. Furthermore, the number of scan driving blocks included in each of the scan driving block groups may be the same as each other.

As described above, the odd numbered scan driving block group (the first scan driving block group and the third scan driving block group) includes a plurality of scan driving blocks receiving at least two different clock signals, among the plurality of scan driving blocks which are sequentially arranged. The even numbered scan driving block group includes a plurality of scan driving blocks receiving at least two clock signals which are the same as at least two clock signals inputted to each of the scan driving blocks included in the odd numbered scan driving block group.

A first line connection signal LRS1 is applied to gate electrodes of line transistors M1, M2, M5, and M6 which are connected to the scan lines of each of the scan driving blocks SR1, SR2, SR5, and SR6 included in the odd numbered scan driving block groups (the first scan driving block group and the third scan driving block group) in parallel among the plurality of scan driving block groups.

A second line connection signal LRS2 is applied to gate electrodes of line transistors M3 and M4 which are connected to the scan lines of each of the scan driving blocks SR3 and SR4 included in the even numbered scan driving block group (the second scan driving block group) in parallel among the plurality of scan driving block groups.

The first line connection signal LRS1 is an inverse signal relative to the second line connection signal LRS2.

The plurality of line transistors M1, M2, M3, M4, M5, M6, . . . connected to the scan lines of each of the plurality of scan driving blocks SR1, SR2, SR3, SR4, SR5, SR6, . . . in parallel may be used when there is a defective scan driving block among the plurality of scan driving blocks SR1, SR2, SR3, SR4, SR5, SR6, . . . .

The aforementioned case shows that there is no defective scan driving block among the plurality of scan driving blocks SR1, SR2, SR3, SR4, SR5, SR6, . . . .

Hereinafter, a method for driving a scan driving device without a defective scan driving block will be described with reference to FIG. 3, and a method for managing a defect of a scan driving device including a defective scan driving block will be described with reference to FIG. 4.

Figure 3:
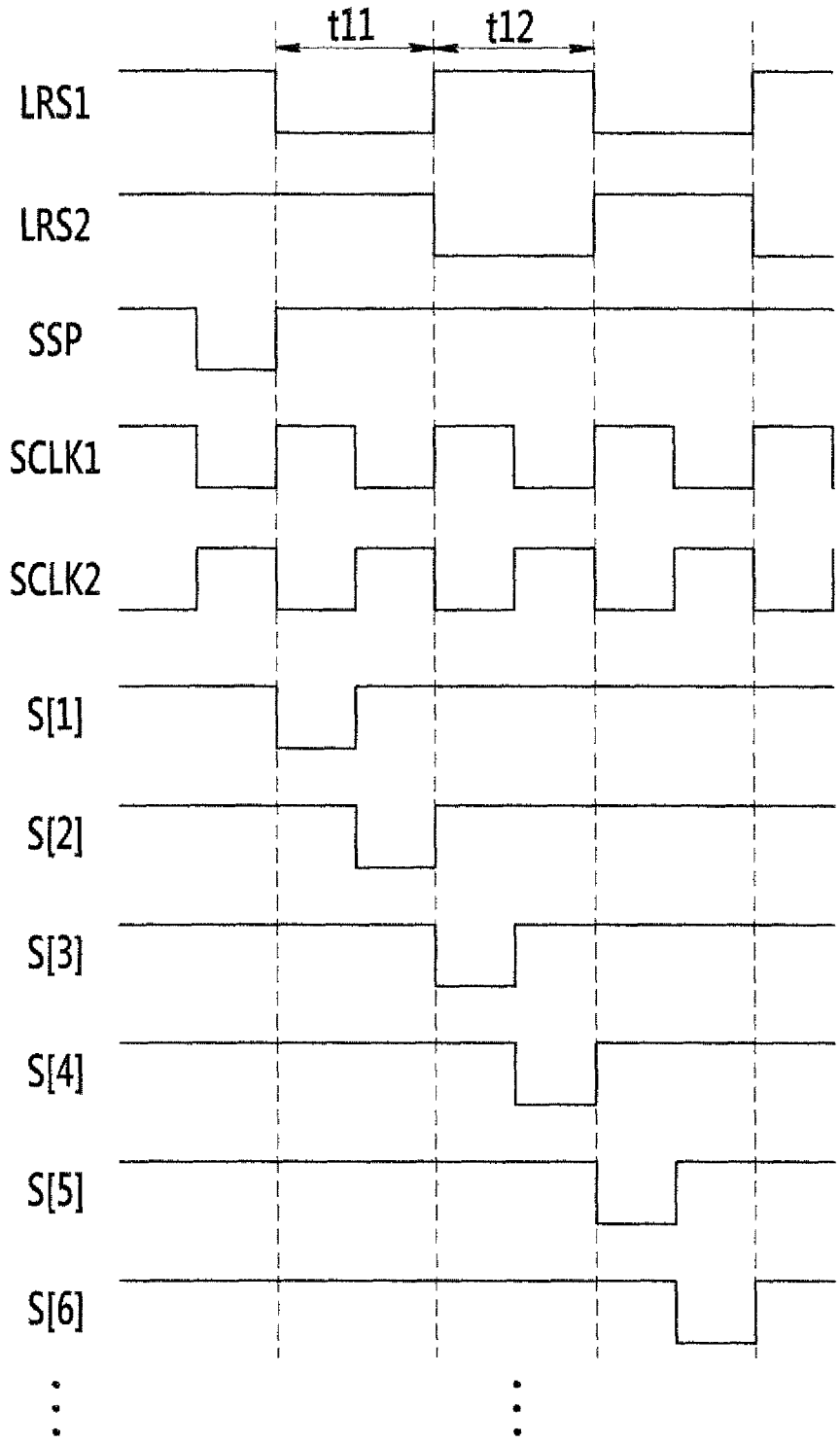
FIG. 3 is a timing diagram illustrating a method for driving a scan driving device according to an exemplary embodiment of the present invention.

FIG. 3 is a timing diagram illustrating a method for driving a scan driving device according to an exemplary embodiment of the present invention.

Referring to FIG. 3, it is assumed that each of the plurality of scan driving blocks SR1, SR2, SR3, SR4, SR5, SR6 included in the scan driving device of FIG. 2 includes a p-channel field effect transistor, that a signal of logic low level is a gate-on signal for driving a scan driving block, and that the plurality of scan driving blocks SR1, SR2, SR3, SR4, SR5, SR6, . . . sequentially output scan signals of logic low level.

A scan start signal SSP is inputted to the input signal input terminal IN of the first scan driving block SR1, the first clock signal SCLK1 is inputted to the first clock signal input terminal CLK1, and the second clock signal SCLK2 is inputted to the second clock signal input terminal CLK2, thereby outputting a scan signal S[1].

The scan signal S[1] of the first scan driving block SR1 is inputted to the input signal input terminal IN of the second scan driving block SR2, the second clock signal SCLK2 is inputted to the first clock signal input terminal CLK1, and the first clock signal SCLK1 is inputted to the second clock signal input terminal CLK2, thereby outputting a scan signal S[2].

In this manner, the plurality of scan driving blocks SR1, SR2, SR3, SR4, SR5, SR6, . . . sequentially output scan signals S[1], S[2], S[3], S[4], S[5], S[6], . . . .

At this point, the first line connection signal LRS1 is applied at a gate-on voltage for a period of time when the plurality of scan driving blocks included in the odd numbered scan driving block groups output the scan signals having a gate-on voltage. Furthermore, the first line connection signal LRS1 is applied at a gate-off voltage for a period of time when the plurality of scan driving blocks included in the even numbered scan driving block group output the scan signals having a gate-on voltage.

The second line connection signal LRS2 is applied at a gate-on voltage for a period of time when the plurality of scan driving blocks included in the even numbered scan driving block group output the scan signals having a gate-on voltage. Furthermore, the second line connection signal LRS2 is applied at a gate-off voltage for a period of time when the scan driving blocks included in the odd numbered scan driving block groups output the scan signals having a gate-on voltage.

For example, the first line connection signal LRS1 is applied at a gate-on voltage for a period of time t11 when the first scan driving block SR1 and the second scan driving block SR2 included in the first scan driving block group output the scan signals S[1] and S[2] having a gate-on voltage, and is applied at the gate-off voltage for a period of time t12 when the third scan driving block SR3 and the fourth scan driving block SR4 included in the second scan driving block group output scan signals S[3] and S[4] having a gate-on voltage.

Furthermore, the second line connection signal LRS2 is applied at a gate-off voltage for the period of time t11 when the first scan driving block SR1 and the second scan driving block SR2 included in the first scan driving block group output scan signals S[1] and S[2] having a gate-on voltage, and is applied at the gate-on voltage for the period of time t12 when the third scan driving block SR3 and the fourth scan driving block SR4 included in the second scan driving block group output scan signals S[3] and S[4] having a gate-on voltage.

The plurality of line transistors M1, M2, M3, M4, M5, M6, . . . are connected in parallel to each of the scan lines. Therefore, the scan signals S[1], S[2], S[3], S[4], S[5], S[6], . . . of each of the scan driving blocks SR1, SR2, SR3, SR4, SR5, SR6, . . . can be normally outputted irrespective of the on or off state of the line transistors M1, M2, M3, M4, M5, and M6.

Figure 4:
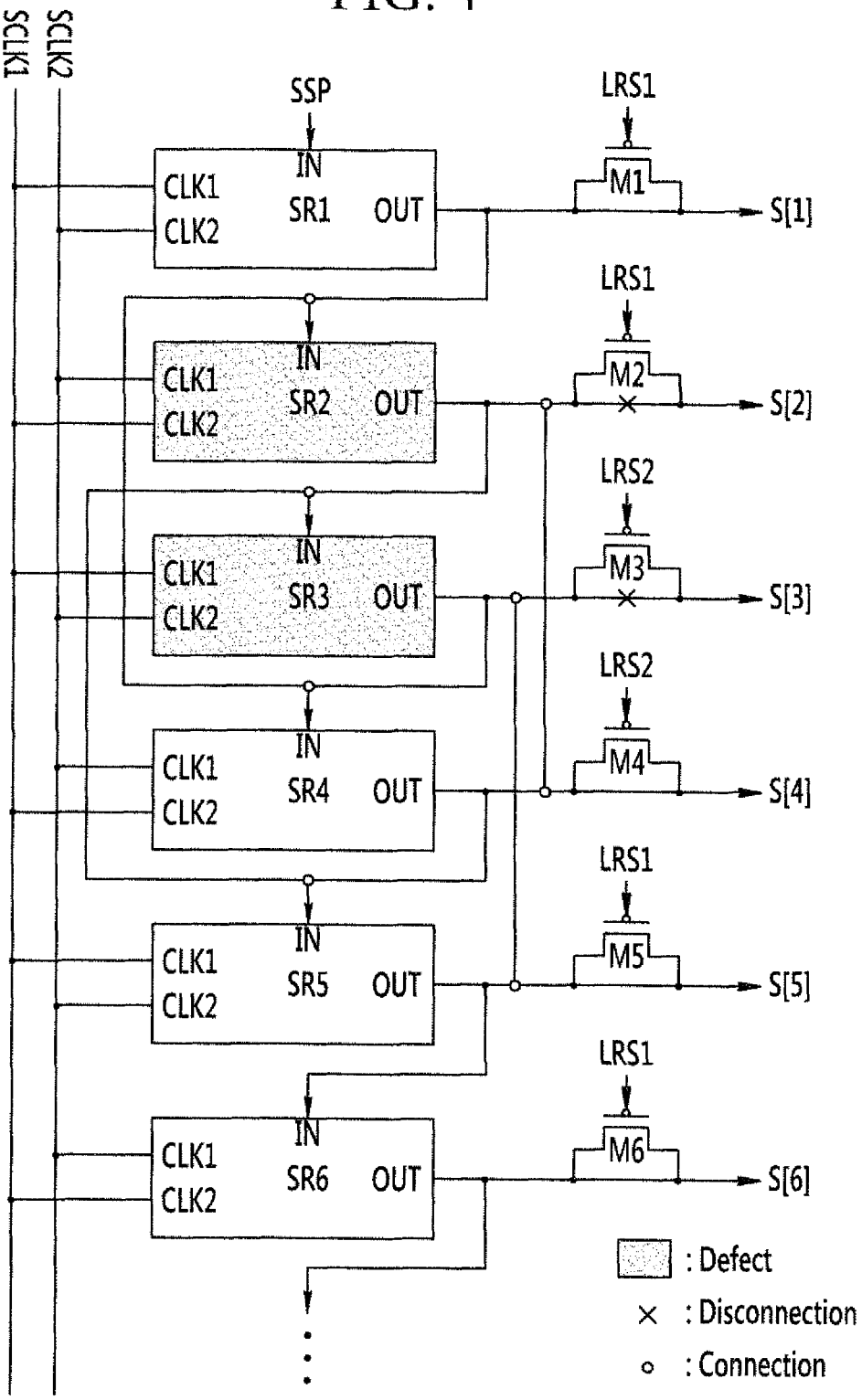
FIG. 4 is an exemplary diagram illustrating a method for managing a defect of a scan driving device according to an exemplary embodiment of the present invention.

FIG. 4 is an exemplary diagram illustrating a method for managing a defect of a scan driving device according to an exemplary embodiment of the present invention.

Referring to FIG. 4, an input terminal of a defective scan driving block among the plurality of scan driving blocks included in the odd numbered scan driving block group is connected to an input terminal of a scan driving block having the same input pattern of the clock signals among the plurality of scan driving blocks included in the even numbered scan driving block group. In this case, in the configuration where scan signals are sequentially outputted, the scan driving block having the same input pattern of the clock signals in the even numbered scan driving block group is a scan driving block outputting a scan signal after the defective scan driving block in the odd numbered scan driving block group.

Furthermore, an output terminal of the defective scan driving block in the odd numbered scan driving block group is connected to an output terminal of the scan driving block having the same input pattern of clock signals in the even numbered scan driving block group.

Thereafter, a scan line of the defective scan driving block in the odd numbered scan driving block group is disconnected to allow a scan signal to be outputted through a line transistor connected in parallel.

In the same manner, an input terminal of a defective scan driving block among the plurality of scan driving blocks included in the even numbered scan driving block group is connected to an input terminal of a scan driving block having the same input pattern of clock signals among the plurality of scan driving blocks included in the odd numbered scan driving block group. In this case, in the configuration where scan signals are sequentially outputted, the scan driving block having the same input pattern of clock signals in the odd numbered scan driving block group is a scan driving block outputting a scan signal after the defective scan driving block in the even numbered scan driving block group.

Then, an output terminal of the defective scan driving block in the even numbered scan driving block group is connected to an output terminal of the scan driving block having the same input pattern of clock signals in the odd numbered scan driving block group.

Thereafter, a scan line of the defective scan driving block in the even numbered scan driving block group is disconnected to allow a scan signal to be outputted through a line transistor connected in parallel.

It is assumed that defects occurred in the second scan driving block SR2 and the third scan driving block SR3 in the scan driving device of FIG. 2.

Referring to FIG. 4, the input terminal IN of the second scan driving block SR2 included in the odd numbered scan driving block group is connected to the input terminal IN of the fourth scan driving block SR4 included in the even numbered scan driving block group. The second scan driving block SR2 and the fourth scan driving block SR4 have the same input pattern of the clock signals SCLK1 and SCLK2 because the second clock signal SCLK2 is inputted to the first clock signal input terminals CLK1 and the first clock signal SCLK1 is inputted to the second clock signal input terminals CLK2. Then, the output terminal OUT of the fourth scan driving block SR4 is connected to the output terminal OUT of the second scan driving block SR2. The scan line of the second scan driving block SR2 is disconnected, and both ends of the disconnected scan line are connected to both ends of the line transistor M2. The gate electrode of the line transistor M2 is connected to a line 1 connection signal line to which the first line connection signal LRS1 is transmitted.

As a result, the fourth scan driving block SR4 can output the scan signal S[2] in place of the second scan driving block SR2 in which the defect occurs.

The input terminal IN of the third scan driving block SR3 is connected to the input terminal IN of the fifth scan driving block SR5. The third scan driving block SR3 and the fifth scan driving block SR5 have the same input pattern of the clock signals SCLK1 and SCLK2 because the first clock signal SCLK1 is inputted to the first clock signal input terminals CLK1 and the second clock signal SCLK2 is inputted to the second clock signal input terminals CLK2. Then, the output terminal OUT of the fifth scan driving block SR5 is connected to the output terminal OUT of the third scan driving block SR3. A scan line of the third scan driving block SR3 is disconnected, and both ends of the disconnected scan line are connected to both ends of the line transistor M3. A gate electrode of the line transistor M3 is connected to a line connection signal line to which the second line connection signal LRS2 is transmitted.

As a result, the fifth scan driving block SR5 can output the scan signal S[3] in place of the third scan driving block SR3 in which the defect occurs.

Hereinafter, a method for driving a scan driving device in which the defect is managed will be described.

Even though the scan signal S[1] of the first scan driving block SR1 is transmitted to the input signal input terminal IN of the second scan driving block SR2, the second scan driving block SR2 is defective and thus does not operate. The scan signal S[1] of the first scan driving block SR1 is applied to the input signal input terminal IN of the fourth scan driving block SR4.

The fourth scan driving block SR4 has the same input pattern of the clock signals SCLK1 and SCLK2 as that of the second scan driving block SR2, and thus operates in the same manner as the second scan driving block SR2, such that the fourth scan driving block SR4 outputs a scan signal for the same period of time as the period of time when the second scan driving block SR2 should output a scan signal. The scan signal of the fourth scan driving block SR4 is transmitted to the output terminal OUT of the second scan driving block SR2. In this case, since the first line connection signal LRS1 is applied at a gate-on voltage, the scan signal of the fourth scan driving block SR4 is applied to a scan line through the line transistor M2 so as to be outputted as the scan signal S[2] of the second scan driving block SR2.

Even though the scan signal S[2] of the second scan line is transmitted to the input signal input terminal IN of the third scan driving block SR3, the third scan driving block SR3 is defective, and thus does not operate. The scan signal S[2] of the second scan driving block SR2 is applied to the input signal input terminal IN of the fifth scan driving block SR5.

The fifth scan driving block SR5 has the same input pattern of the clock signals SCLK1 and SCLK2 as the third scan driving block SR3, and thus operates in the same manner as the third scan driving block SR3, such that the fifth scan driving block SR5 outputs a scan signal for the same period of time as the period of time when the third scan driving block SR3 should output a scan signal. The scan signal of the fifth scan driving block SR5 is transmitted to the output terminal OUT of the third scan driving block SR3. In this case, since the second line connection signal LRS2 is applied at a gate-on voltage, the scan signal of the fifth scan driving block SR5 is applied to a scan line through the line transistor M3 so as to be outputted as the scan signal S[3] of the third scan driving block SR3.

The scan signal S[3] of the third scan line is transmitted to the input signal input terminal IN of the fourth scan driving block SR4, and the fourth scan driving block SR4 outputs the scan signal S[4] to the output terminal OUT. The scan signal S[4] of the fourth scan driving block SR4 is outputted through its own scan line which is not disconnected. Then, the scan signal S[4] of the fourth scan driving block SR4 is transmitted to the output terminal OUT of the second scan driving block SR2. However, when the scan signal S[4] of the fourth scan driving block SR4 is outputted, the first line connection signal LRS1 is applied at a gate-off voltage, and thus the scan signal S[4] of the fourth scan driving block SR4 is not outputted to the scan line of the second scan driving block SR2.

Then, the scan signal S[4] of the fourth scan driving block SR4 is transmitted to the input signal input terminal IN of the fifth scan driving block SR5, and the fifth scan driving block SR5 outputs the scan signal S[5] to the output terminal OUT. The scan signal S[5] of the fifth scan driving block SR5 is outputted through its own scan line which is not disconnected. Then, the scan signal S[5] of the fifth scan driving block SR5 is transmitted to the output terminal OUT of the third scan driving block SR3. However, when the scan signal S[5] of the fifth scan driving block SR5 is outputted, the second line connection signal LRS2 is applied at a gate-off voltage, and thus the scan signal S[5] of the fifth scan driving block SR5 is not outputted to the scan line of the third scan driving block SR3.

Meanwhile, when the scan signal of the fourth scan driving block SR4 is outputted as the scan signal S[2] of the second scan driving block SR2, the scan signal is outputted to the scan line of the fourth scan driving block SR4 as well. Therefore, a data signal corresponding to the scan signal S[2] of the second scan driving block SR2 is inputted to a plurality of pixels connected to the fourth scan line, as well as a plurality of pixels connected to the second scan line. In this case, the erroneous data signal is inputted to the plurality of pixels connected to the fourth scan line. However, thereafter, when the scan signal S[4] of the fourth scan driving block SR4 is outputted, a data signal corresponding to the scan signal S[4] is inputted to the plurality of pixels connected to the fourth scan line, and thus the erroneously inputted data signal is updated to an exact data signal.

Similarly, even when the fifth scan driving block SR5 outputs the scan signal S[3] in place of the third scan driving block SR3, an erroneous data signal may be inputted to a plurality of pixels connected to the fifth scan line, but the erroneously inputted data signal is updated to an exact data signal by the scan signal S[5] which is subsequently applied.

As described above, the signal input to the input signal input terminal of the first defective scan driving block, among the plurality of scan driving blocks included in the odd numbered (even numbered) scan driving block group, is applied to the input terminal of the second scan driving block having the same input pattern of the clock signals among the plurality of scan driving blocks included in the even numbered (odd numbered) scan driving block group. It is possible to normally output the scan signal of the first scan driving block by applying the scan signal output from the second scan driving block in the even numbered (odd numbered) scan driving block group to the scan line of the first defective scan driving block. Furthermore, when the second scan driving block of the even numbered (odd numbered) scan driving block group outputs the scan signal in its own turn, the line transistor connected to the scan line of the first scan driving block is turned off so that the scan signal of the second scan driving block is not outputted to the scan line of the first scan driving block.

Accordingly, even though the defective scan driving block is included in the scan driving device, it is possible for the plurality of scan driving block SR1, SR2, SR3, SR4, SR5, SR6, . . . to sequentially output the scan signal S[1], S[2], S[3], S[4], S[5], S[6], . . . , as shown in FIG. 3. That is, it is possible for the scan driving device which includes the defective scan driving block to operate normally.

Therefore, when a defect of a scan driving block occurs in a production process of the scan driving device, it is possible to manage the defect of the scan driving device by the aforementioned method, thereby improving a yield in the production process of the scan driving device.

Figure 5:
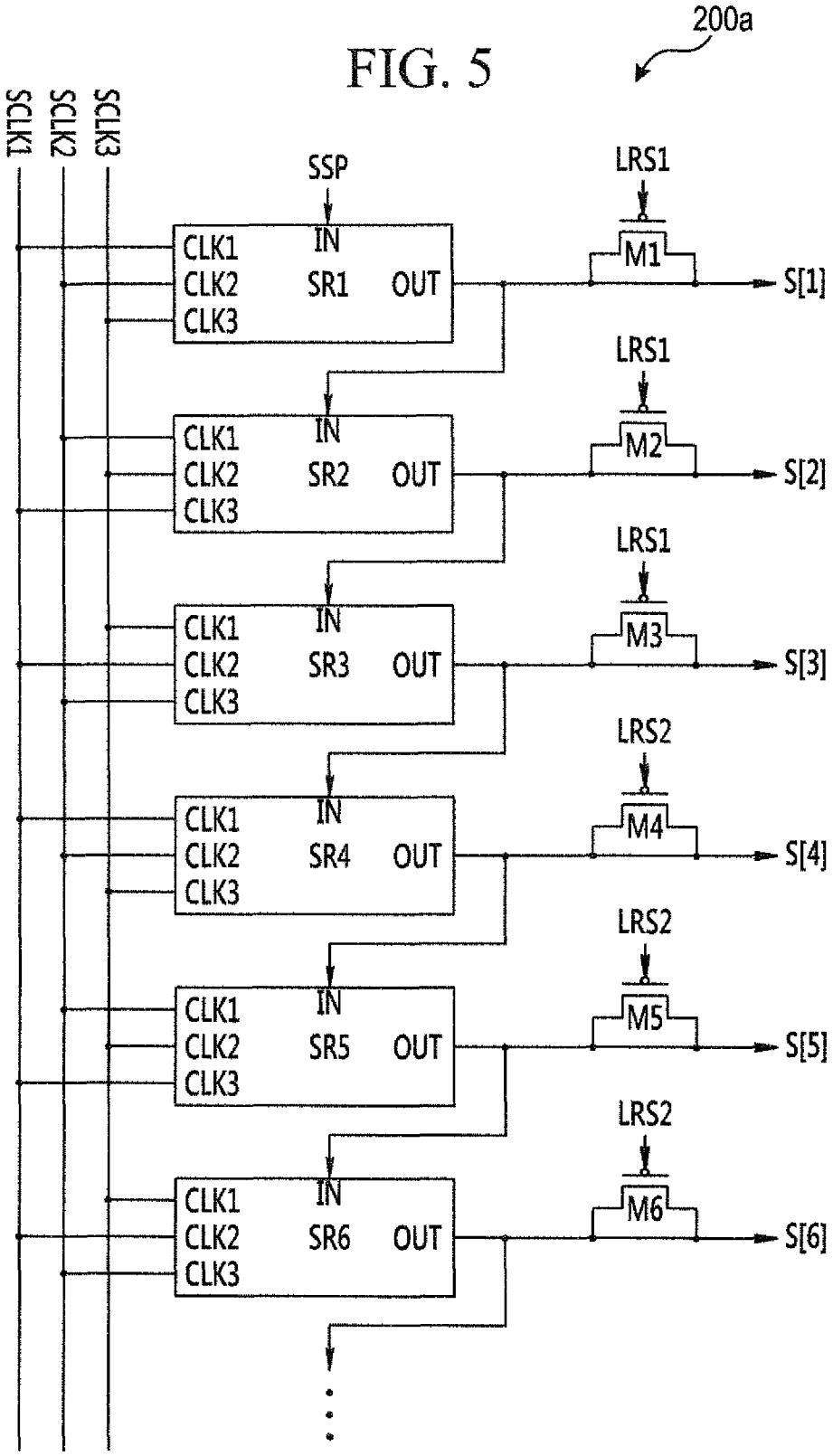
FIG. 5 is a block diagram showing the configuration of a scan driving device according to another exemplary embodiment of the present invention.
Figure 6:
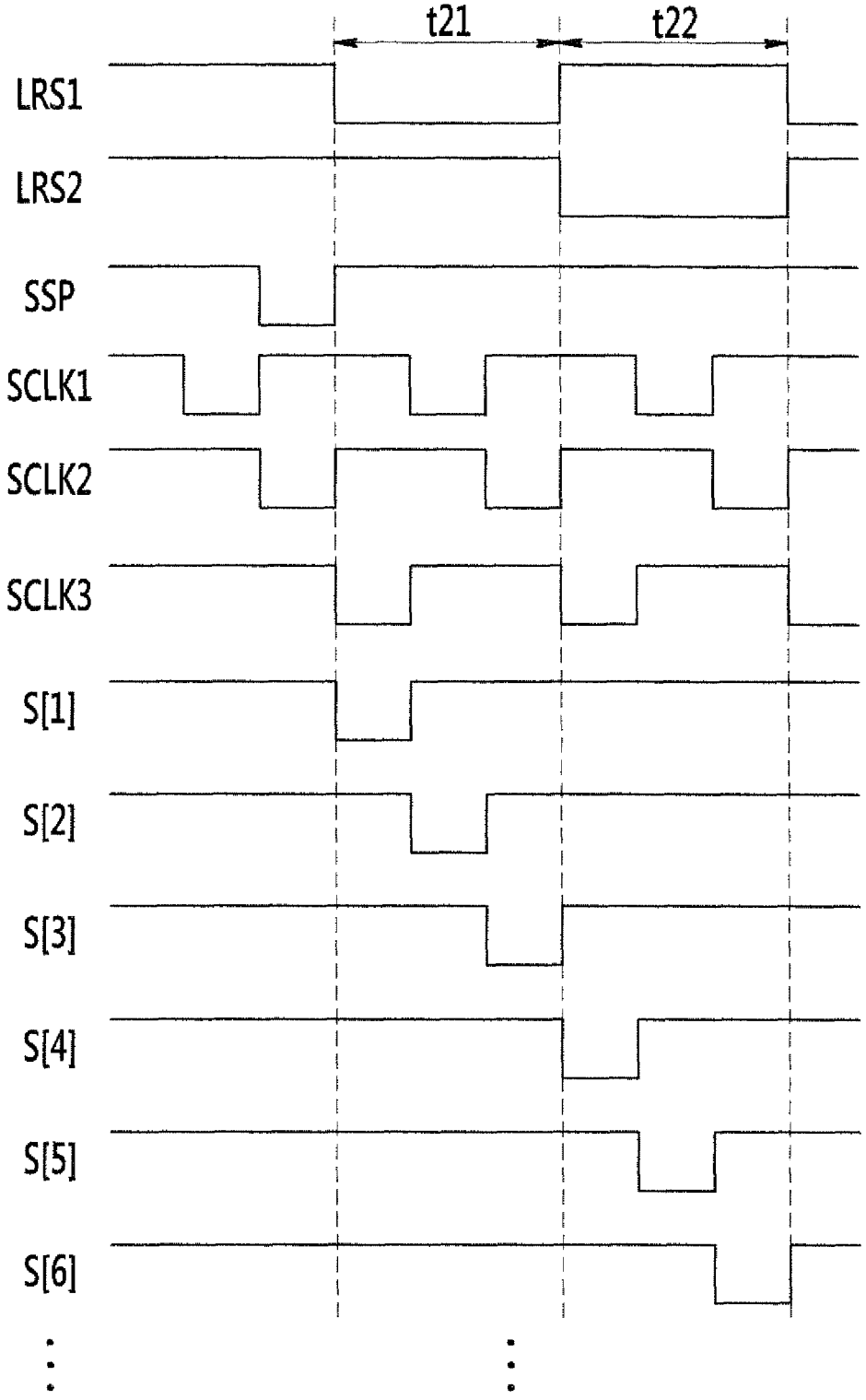
FIG. 6 is a timing diagram illustrating a method for driving a scan driving device according to another exemplary embodiment of the present invention.

FIG. 5 is a block diagram showing the configuration of a scan driving device according to another exemplary embodiment of the present invention, and FIG. 6 is a timing diagram illustrating a method for driving a scan driving device according to another exemplary embodiment of the present invention.

Referring to FIG. 5, the scan driving device 200*a* includes a plurality of scan driving blocks SR1, SR2, SR3, SR4, SR5, SR6, . . . which are sequentially arranged, and a plurality of line transistors M1, M2, M3, M4, M5, M6, . . . which are connected in parallel to scan lines of each of the plurality of scan driving blocks SR1, SR2, SR3, SR4, SR5, SR6, . . . .

The scan driving device 200*a* is different from the scan driving device 200 of FIG. 2 in that each of the plurality of scan driving blocks SR1, SR2, SR3, SR4, SR5, SR6, . . . further includes a third clock signal input terminal CLK3, and three clock signals SCLK1, SCLK2, and SCLK3 are applied to three clock signal input terminals CLK1, CLK2, and CLK3 in three input patterns.

As in a first scan driving block SR1 and a fourth scan driving block SR4, there is a first input pattern in which a first clock signal SCLK1 is inputted to first clock signal input terminals CLK1, a second clock signal SCLK2 is inputted to the second clock signal input terminals CLK2, and a third clock signal SCLK3 is inputted to the third clock signal input terminals CLK3.

As in a second scan driving block SR2 and a fifth scan driving block SR5, there is a second input pattern in which the second clock signal SCLK2 is inputted to first clock signal input terminals CLK1, the third clock signal SCLK3 is inputted to second clock signal input terminals CLK2, and the first clock signal SCLK1 is inputted to third clock signal input terminals CLK3.

As in a third scan driving block SR3 and a sixth scan driving block SR6, there is a third input pattern in which the third clock signal SCLK3 is inputted to first clock signal input terminals CLK1, the first clock signal SCLK1 is inputted to second clock signal input terminals CLK2, and the second clock signal SCLK2 is inputted to third clock signal input terminals CLK3.

When the plurality of scan driving blocks SR1, SR2, SR3, SR4, SR5, SR6, . . . which are sequentially arranged are classified into a plurality of scan driving block groups including the plurality of scan driving blocks having different input patterns of the clock signals SCLK1, SCLK2, and SCLK3, a scan driving block group includes three scan driving blocks.

A first scan driving block group includes the first scan driving block SR1, the second scan driving block SR2, and the third scan driving block SR3. A second scan driving block group includes the fourth scan driving block SR4, the fifth scan driving block SR5, and the sixth scan driving block SR6. The number of scan driving blocks included in one scan driving block group is proportional to the number of clock signals SCLK1, SCLK2, and SCLK3, and the number of scan driving blocks included in each of the scan driving block groups may be the same as each other.

A first line connection signal LRS1 is applied in parallel to gate electrodes of line transistors M1, M2, and M3 connected to scan lines of each of the scan driving blocks SR1, SR2, and SR3 included in an odd numbered scan driving block group (first scan driving block group) among the plurality of scan driving block groups.

A second line connection signal LRS2 is applied in parallel to gate electrodes of line transistors M4, M5, and M6 connected to scan lines of each of the scan driving blocks SR4, SR5, and SR6 included in an even numbered scan driving block group (second scan driving block group) among the plurality of scan driving block groups.

Hereinafter, a method for driving a scan driving device without a defective scan driving block will be described with reference to FIG. 6.

Referring to FIG. 6, it is assumed that each of the plurality of scan driving blocks SR1, SR2, SR3, SR4, SR5, SR6, . . . included in the scan driving device 200*a* of FIG. 5 includes a p-channel field effect transistor, that a signal of logic low level is a gate-on signal for driving a scan driving block, and that the plurality of scan driving blocks SR1, SR2, SR3, SR4, SR5, SR6, . . . sequentially output scan signals of logic low level.

In the first scan driving block SR1, a scan start signal SSP is inputted to an input signal input terminal IN, the first clock signal SCLK1 is inputted to the first clock signal input terminal CLK1, the second clock signal SCLK2 is inputted to the second clock signal input terminal CLK2, and the third clock signal SCLK3 is inputted to the third clock signal input terminal CLK3, thereby outputting a scan signal S[1].

In the second scan driving block SR2, the scan signal S[1] of the first scan driving block SR1 is inputted to an input signal input terminal IN, the second clock signal SCLK2 is inputted to the first clock signal input terminal CLK1, the third clock signal SCLK3 is inputted to the second clock signal input terminal CLK2, and the first clock signal SCLK1 is inputted to the third clock signal input terminal CLK3, thereby outputting a scan signal S[2].

In the third scan driving block SR3, the scan signal S[2] of the second scan driving block SR2 is inputted to an input signal input terminal IN, the third clock signal SCLK3 is inputted to the first clock signal input terminal CLK1, the first clock signal SCLK1 is inputted to the second clock signal input terminal CLK2, and the second clock signal SCLK2 is inputted to the third clock signal input terminal CLK3, thereby outputting a scan signal S[3].

In this manner, the plurality of scan driving blocks SR1, SR2, SR3, SR4, SR5, SR6, . . . sequentially output scan signal S[1], S[2], S[3], S[4], S[5], S[6], . . . .

In this case, the first line connection signal LRS1 is applied at a gate-on voltage for a period of time when the plurality of scan driving blocks included in odd numbered scan driving block group (the first scan driving block group) output the scan signals having a gate-on voltage. Furthermore, the first line connection signal LRS1 is applied at a gate-off voltage for a period of time when the plurality of scan driving blocks included in the even numbered scan driving block group output scan signals having a gate-on voltage.

The second line connection signal LRS2 is applied at a gate-on voltage for a period of time when the plurality of scan driving blocks included in the even numbered scan driving block group (the second scan driving block group) output scan signals having a gate-on voltage. Furthermore, the second line connection signal LRS2 is applied at a gate-off voltage for a period of time when the plurality of scan driving blocks included in the odd numbered scan driving block group output scan signals having a gate-on voltage.

For example, referring to FIG. 6, the first line connection signal LRS1 is applied at a gate-on voltage for a period of time t21 when the first scan driving block SR1, the second scan driving block SR2, and the third scan driving block SR3 included in the first scan driving block group output the scan signals S[1], S[2], and S[3] having a gate-on voltage, and is applied at a gate-off voltage for a period of time t22 when the fourth scan driving block SR4, the fifth scan driving block SR5, and the sixth scan driving block SR6 included in the second scan driving block group output scan signal S[4], S[5], and S[6] having a gate-on voltage.

Furthermore, the second line connection signal LRS2 is applied at a gate-off voltage for the period of time t21 when the first scan driving block SR1, the second scan driving block SR2, and the third scan driving block SR3 included in the first scan driving block group output the scan signals S[1], S[2], and S[3] having a gate-on voltage, and is applied at a gate-on voltage for the period of time t22 when the fourth scan driving block SR4, the fifth scan driving block SR5, and the sixth scan driving block SR6 included in the second scan driving block group output scan signals S[4], S[5], and S[6] having a gate-on voltage.

Since the plurality of line transistors M1, M2, M3, M4, M5, M6, . . . are connected in parallel to each of the scan lines, scan signals S[1], S[2], S[3], S[4], S[5], S[6], . . . of the scan driving blocks SR1, SR2, SR3, SR4, SR5, SR6, . . . can be normally outputted irrespective of the on or off state of the line transistors M1, M2, M3, M4, M5, and M6.

Figure 7:
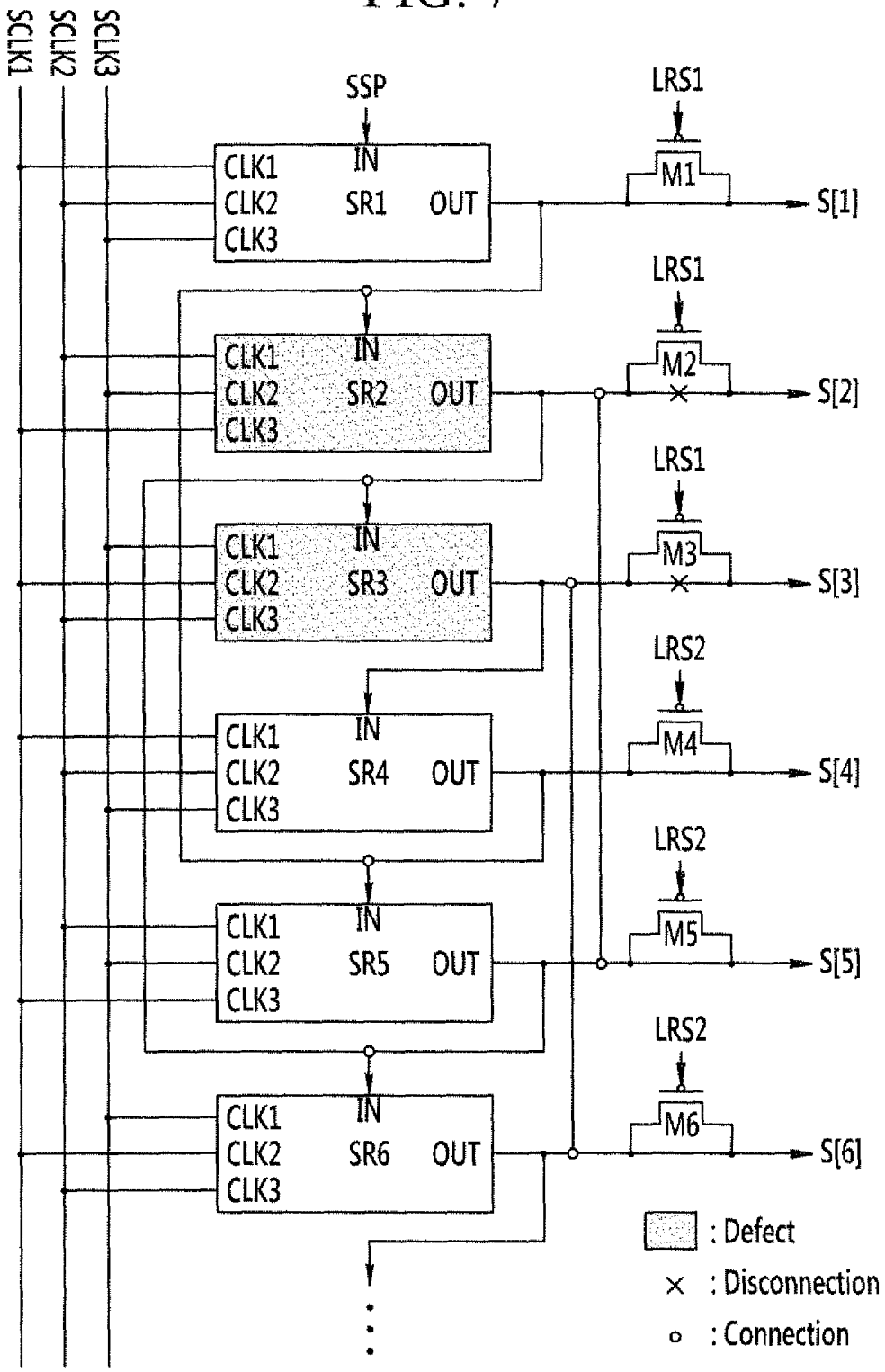
FIG. 7 is an exemplary diagram illustrating a method for managing a defect of a scan driving device according to another exemplary embodiment of the present invention.

FIG. 7 is an exemplary diagram illustrating a method for managing a defect of a scan driving device according to another exemplary embodiment of the present invention.

Referring to FIG. 7, it is assumed that defects occurred in the second scan driving block SR2 and the third scan driving block SR3 of the scan driving device 200*a* of FIG. 5.

The input terminal IN of the second scan driving block SR2, included in the odd numbered scan driving block group, is connected to the input terminal IN of the fifth scan driving block SR5 which has the same input pattern of the clock signals SCLK1, SCLK2, and SCLK3, and is included in the even numbered scan driving block group. Then, the output terminal OUT of the second scan driving block SR2 is connected to the output terminal OUT of the fifth scan driving block SR5. Thereafter, a scan line of the second scan driving block SR2 is disconnected, and both ends of the disconnected scan line are connected to both ends of the line transistor M2.

As a result, the fifth scan driving block SR5 can output the scan signal S[2] in place of the second scan driving block SR2 in which the defect occurs.

In the same manner, the input terminal IN of the third scan driving block SR3, included in the odd numbered scan driving block group, is connected to the input terminal IN of the sixth scan driving block SR6 which has the same input pattern of the clock signals SCLK1, SCLK2, and SCLK3 and is included in the even numbered scan driving block group. Then, the output terminal OUT of the third scan driving block SR3 is connected to the output terminal OUT of the sixth scan driving block SR6. Thereafter, a scan line of the third scan driving block SR3 is disconnected, and both ends of the disconnected scan line are connected to both ends of the line transistor M3.

As a result, the sixth scan driving block SR6 can output the scan signal S[3] in place of the third scan driving block SR3 in which the defect occurs.

Hereinafter, a method for driving the scan driving device in which the defects are managed will be described.

The scan signal S[1] of the first scan driving block SR1 is applied to the input signal input terminal IN of the fifth scan driving block SR5, and thus the fifth scan driving block SR5 generates the scan signal S[2] in place of the second scan driving block SR2 so as to apply the scan signal S[2] to the scan line of the second scan driving block SR2. The line transistor M2 of the second scan driving block SR2 is in a turned-on state according to the first line connection signal LRS1, and the scan signal S[2] is outputted to the second scan line.

The scan signal S[2] of the second scan line is applied to the input signal input terminal IN of the sixth scan driving block SR6, and the sixth scan driving block SR6 generates the scan signal S[3] in place of the third scan driving block SR3 so as to apply the scan signal S[3] to the scan line of the third scan driving block SR3. The line transistor M3 of the third scan driving block SR3 is in a turned-on state according to the first line connection signal LRS1, and the scan signal S[3] is outputted to the third scan line.

Thereafter, since the first line connection signal LRS1 is applied at a gate-off voltage for a period of time when the fifth scan driving block SR5 and the sixth scan driving block SR6 output scan signals S[5] and S[6] to each scan line, the line transistor M2 of the second scan driving block SR2 and the line transistor M3 of the third scan driving block SR3 are in a turned-off state, and no scan signal is outputted to the second scan line and the third scan line.

Furthermore, when the fifth scan driving block SR5 outputs the scan signal S[2] in place of the second scan driving block SR2, and when the sixth scan driving block SR6 outputs the scan signal S[3] in place of the third scan driving block SR3, data signals erroneously inputted to a plurality of pixels connected to the fifth scan line and to a plurality of pixels connected to the sixth scan line are updated to exact data signals for a period of time when the fifth scan driving block SR5 and the sixth scan driving block SR6 output the scan signals S[5] and S[6] to each scan line.

Accordingly, even though the defective scan driving block is included in the scan driving device, it is possible for the plurality of scan driving blocks SR1, SR2, SR3, SR4, SR5, SR6, . . . to sequentially output the scan signals S[1], S[2], S[3], S[4], S[5], S[6], . . . as shown in FIG. 7. That is, it is possible for the scan driving device which includes the defective scan driving block to operate normally.

Figure 8:
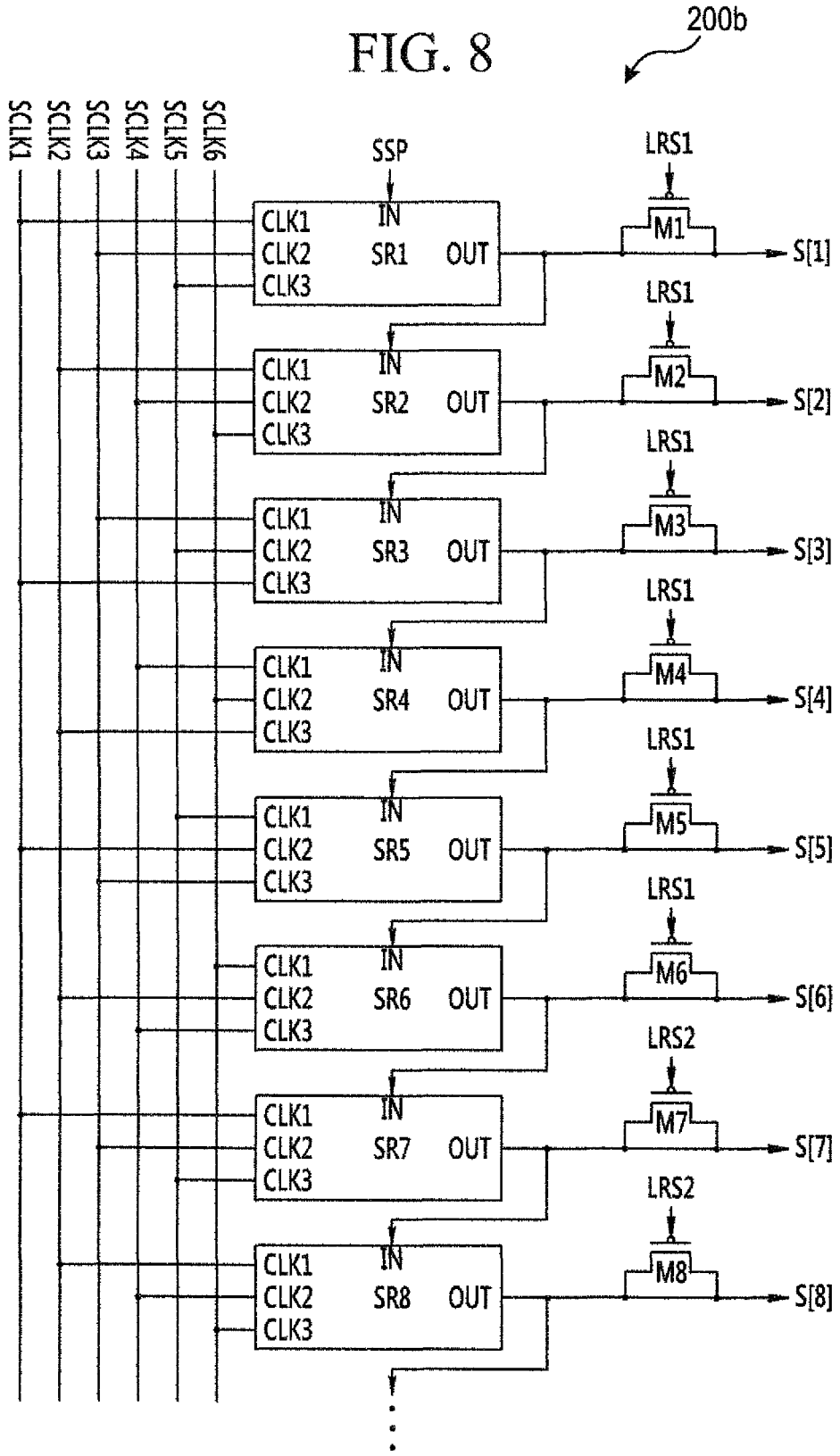
FIG. 8 is a block diagram showing the configuration of a scan driving device according to yet another exemplary embodiment of the present invention.

FIG. 8 is a block diagram showing the configuration of a scan driving device according to yet another exemplary embodiment of the present invention.

Referring to FIG. 8, a scan driving device 200*b* includes a plurality of scan driving blocks SR1, SR2, SR3, SR4, SR5, SR6, SR7, SR8, . . . which are sequentially arranged, and a plurality of line transistors M1, M2, M3, M4, M5, M6, M7, M8 . . . which are connected in parallel to scan lines of each of the plurality of scan driving blocks SR1, SR2, SR3, SR4, SR5, SR6, SR7, SR8, . . . .

The scan driving device 200*b* is different from the scan driving device 200 of FIG. 2 in that each of the plurality of scan driving blocks SR1, SR2, SR3, SR4, SR5, SR6, SR7, SR8, . . . further includes a third clock signal input terminal CLK3, and six clock signals SCLK1, SCLK2, SCLK3, SCLK4, SCLK5, and SCLK6 are applied to three clock signal input terminals CLK1, CLK2, and CLK3 in six input patterns.

As in a first scan driving block SR1 and a seventh scan driving block SR7, there is a first input pattern in which a first clock signal SCLK1 is inputted to first clock signal input terminals CLK1, a third clock signal SCLK3 is inputted to second clock signal input terminals CLK2, and a fifth clock signal SCLK5 is inputted to third clock signal input terminals CLK3.

As in a second scan driving block SR2 and an eighth scan driving block SR8, there is a second input pattern in which a second clock signal SCLK2 is inputted to a first clock signal input terminals CLK1, a fourth clock signal SCLK4 is inputted to second clock signal input terminals CLK2, and a sixth clock signal SCLK6 is inputted to third clock signal input terminals CLK3.

As in a third scan driving block SR3, there is a third input pattern in which the third clock signal SCLK3 is inputted to a first clock signal input terminal CLK1, a fifth clock signal SCLK5 is inputted to a second clock signal input terminal CLK2, and the first clock signal SCLK1 is inputted to a third clock signal input terminal CLK3.

As in a fourth scan driving block SR4, there is a fourth input pattern in which the fourth clock signal SCLK4 is inputted to a first clock signal input terminal CLK1, the sixth clock signal SCLK6 is inputted to the second clock signal input terminal CLK2, and the second clock signal SCLK2 is inputted to the third clock signal input terminal CLK3.

As in a fifth scan driving block SR5, there is a fifth input pattern in which the fifth clock signal SCLK5 is inputted to a first clock signal input terminal CLK1, the first clock signal SCLK1 is inputted to a second clock signal input terminal CLK2, and the third clock signal SCLK3 is inputted to a third clock signal input terminal CLK3.

As in a sixth scan driving block SR6, there is a sixth input pattern in which the sixth clock signal SCLK6 is inputted to a first clock signal input terminal CLK1, the second clock signal SCLK2 is inputted to a second clock signal input terminal CLK2, and the fourth clock signal SCLK4 is inputted to a third clock signal input terminal CLK3.

When the plurality of scan driving blocks SR1, SR2, SR3, SR4, SR5, SR6, SR7, SR8, . . . which are sequentially arranged are classified into a plurality of scan driving block groups including the plurality of scan driving blocks having different input patterns of the clock signals SCLK1, SCLK2, SCLK3, SCLK4, SCLK5, and SCLK6 from each other, a scan driving block group includes six scan driving blocks.

A first scan driving block group includes the first scan driving block SR1, the second scan driving block SR2, the third scan driving block SR3, the fourth scan driving block SR4, the fifth scan driving block SR5, and the sixth scan driving block SR6. A second scan driving block group includes the seventh scan driving block SR7, the eighth scan driving block SR8, a ninth scan driving block (not shown), a tenth scan driving block (not shown), an eleventh scan driving block (not shown), and a twelfth scan driving block (not shown). The number of scan driving blocks included in one scan driving block group is proportional to the number of clock signals SCLK1, SCLK2, SCLK3, SCLK4, SCLK5 and SCLK6, and the number of scan driving blocks included in each of the scan driving block groups may be the same as each other.

A first line connection signal LRS1 is applied in parallel to gate electrodes of line transistors M1, M2, M3, M4, M5, and M6 connected to scan lines of each of the scan driving blocks SR1, SR2, SR3, SR4, SR5, and SR6 included in an odd numbered scan driving block group (first scan driving block group) among the plurality of scan driving block groups.

A second line connection signal LRS2 is applied in parallel to gate electrodes of line transistors M7 to M12 (not shown) connected to scan lines of each of the scan driving blocks SR7 to SR12 (not shown) included in an even numbered scan driving block group (second scan driving block group) among the plurality of scan driving block groups.

Hereinafter, a method for driving a scan driving device without a defective scan driving block will be described with reference to FIG. 9, and a method for managing a defect in a scan driving device including a defective scan driving block will be described with reference to FIG. 10.

Figure 9:
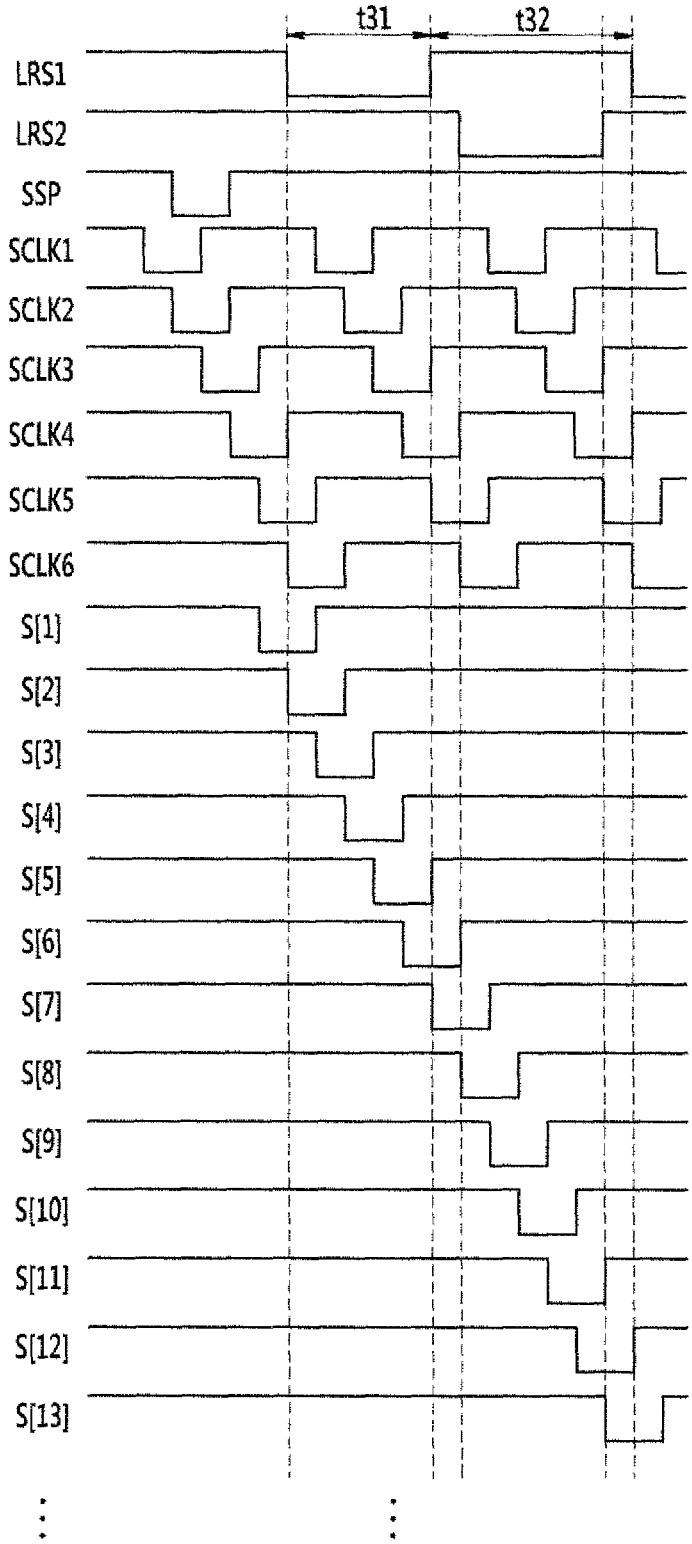
FIG. 9 is a timing diagram illustrating a method for driving a scan driving device according to yet another exemplary embodiment of the present invention.

FIG. 9 is a timing diagram illustrating a method for driving a scan driving device according to yet another exemplary embodiment of the present invention.

Referring to FIG. 9, it is assumed that each of the scan driving blocks SR1, SR2, SR3, SR4, SR5, SR6, SR7, SR8, . . . included in the scan driving device 200*b* of FIG. 8 includes a p-channel field effect transistor, that a signal of logic low level is a gate-on signal for driving a scan driving block, and that the plurality of scan driving blocks SR1, SR2, SR3, SR4, SR5, SR6, SR7, SR8, . . . sequentially output scan signals of logic low level.

Eight scan driving blocks SR1 to SR8 are shown in FIG. 8, but herein, waveforms of thirteen scan signals S[1] to S[13] are shown for the purpose of description.

The first scan driving block SR1 is synchronized with a scan start signal SSP inputted to the input signal input terminal IN so as to output a scan signal S[1].

The second scan driving block SR2 is synchronized with the scan signal S[1] of the first scan driving block SR1 so as to output a scan signal S[2].

In this manner, the plurality of scan driving blocks sequentially output scan signals S[1], S[2], S[3], S[4], S[5], S[6], S[7], S[8], S[9], S[10], S[11], S[12], S[13], . . . .

The plurality of clock signals SCLK1, SCLK2, SCLK3, SCLK4, SCLK5, and SCLK6 are sequentially shifted by ½ duty and applied. A duty refers to a period of time when a gate-on voltage turning on a transistor included in a scan driving block is applied. The scan signals S[1], S[2], S[3], S[4], S[5], S[6], S[7], S[8], S[9], S[10], S[11], S[12], S[13], . . . are sequentially shifted by ½ duty and outputted. That is, the sequentially outputted scan signals S[1], S[2], S[3], S[4], S[5], S[6], S[7], S[8], S[9], S[10], S[11], S[12], S[13], . . . are outputted while overlapping with each other by ½ duty.

A scan driving block included in a next even numbered (odd numbered) scan driving block group generates a scan signal in place of a defective scan driving block among the plurality of scan driving blocks included in an odd numbered (even numbered) scan driving block group. When the scan driving block included in the next even numbered (odd numbered) scan driving block group generates the scan signal, the scan signal should not be outputted to a scan line of the defective scan driving block. Signals controlling this are the first line connection signal LRS1 and the second line connection signal LRS2.

Therefore, in the case where the sequentially output scan signals S[1], S[2], S[3], S[4], S[5], S[6], S[7], S[8], S[9], S[10], S[11], S[12], S[13], . . . are outputted while overlapping with each other by ½ duty, the first line connection signal LRS1 should be applied at a gate-off voltage for a period of time t32 when the plurality of scan driving blocks (for example, SR7 to SR12 (not shown)) included in the even numbered scan driving block group output the scan signals S[7] to S[12] having a gate-on voltage. Furthermore, the first line connection signal LRS1 is applied at a gate-on voltage for a period of time t31 when the plurality of scan driving blocks (for example, SR1 to SR6) included in the odd numbered scan driving block group output the scan signals S[1] to S[6] having a gate-on voltage, other than the period of time t32 when the first line connection signal LRS1 is applied at a gate-off voltage.

For example, when a defect occurs in the first scan driving block SR1 among the scan driving blocks included in the odd numbered scan driving block group, the seventh scan driving block SR7 included in the even numbered scan driving block group may output the scan signal S[1] in place of the first scan driving block SR1. Thereafter, when outputting the corresponding scan signal S[7] to a scan line of the seventh scan driving block SR7, the scan signal of the seventh scan driving block SR7 is transmitted to an output terminal OUT of the first scan driving block SR1 as well. In this case, the first line connection signal LRS1 is applied at a gate-off voltage, and thus the scan signal is not outputted to the scan line of the first scan driving block SR1. However, when the seventh scan driving block SR7 outputs the scan signal S[1] in place of the first scan driving block SR1, there is a section where the first line connection signal LRS1 is not applied at a gate-on voltage by ½ duty of a period of time when the scan signal S[1] is outputted. However, even when the gate-on voltage is applied by only ½ duty, data signals can be sufficiently inputted to a plurality of pixels connected to the first scan line.

Similarly, the second line connection signal LRS2 is applied at a gate-off voltage for the period of time t31 when the plurality of scan driving blocks (for example, SR1 to SR6) included in the odd numbered scan driving block group output the scan signals S[1] to S[6] having a gate-on voltage, and is applied at a gate-on voltage for the period of time t32 when the plurality of scan driving blocks (for example, SR7 to SR12 (not shown)) included in the even numbered scan driving block group output the scan signals S[7] to S[12] of a gate-on voltage, other than the period of time t31 when the second line connection signal LRS2 is applied at a gate-off voltage.

Figure 10:
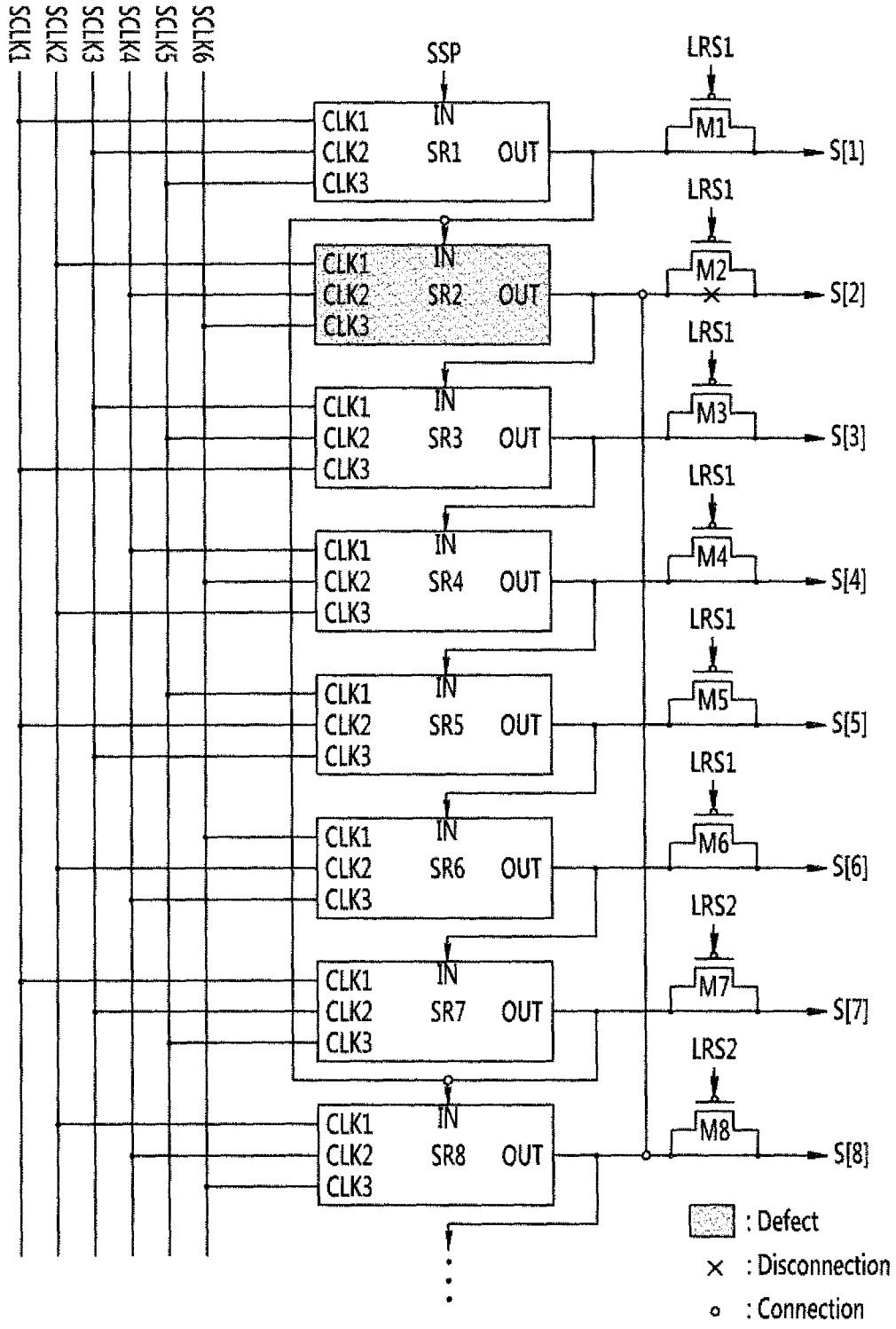
FIG. 10 is an exemplary diagram illustrating a method for managing a defect of a scan driving device according to yet another exemplary embodiment of the present invention.

FIG. 10 is an exemplary diagram illustrating a method for managing a defect of a scan driving device according to yet another exemplary embodiment of the present invention.

Referring to FIG. 10, it is assumed that a defect occurred in the second scan driving block SR2 in the scan driving device 200*b* of FIG. 8.

An input terminal IN of the second scan driving block SR2, included in the odd numbered scan driving block group, is connected to an input terminal IN of the eighth scan driving block SR8 which has the same input pattern of the clock signals SCLK1, SCLK2, SCLK3, SCLK4, SCLK5 and SCLK6, and which is included in the even numbered scan driving block group. Then, an output terminal OUT of the second scan driving block SR2 is connected to an output terminal OUT of the eighth scan driving block SR8. Thereafter, a scan line of the second scan driving block SR2 is disconnected, and both ends of the disconnected scan line are connected to both ends of the line transistor M2.

As a result, the eighth scan driving block SR8 can output a scan signal S[2] in place of the second scan driving block SR2 in which the defect occurs.

Hereinafter, a method for driving a scan driving device in which the defect is managed will be described.

The scan signal S[1] of the first scan driving block SR1 is applied to the input signal input terminal IN of the eighth scan driving block SR8, and thus the eighth scan driving block SR8 generates the scan signal S[2] in place of the second scan driving block SR2 so as to apply the scan signal S[2] to the scan line of the second scan driving block SR2. The line transistor M2 of the second scan driving block SR2 is in a turned-on state according to the first line connection signal LRS1, and the scan signal S[2] is outputted to the second scan line.

Thereafter, since the first line connection signal LRS1 is applied at a gate-off voltage for a period of time when the eighth scan driving block SR8 outputs a scan signal S[8] to a scan line, the line transistor M2 of the second scan driving block SR2 is in a turned-off state, and the scan signal is not outputted to the second scan line.

Furthermore, when the eighth scan driving block SR8 outputs the scan signal S[2] in place of the second scan driving block SR2, a data signal erroneously inputted to a plurality of pixels connected to the eighth scan line is updated to an exact data signal for a period of time when the eighth scan driving block SR8 outputs the scan signal S[8] to the scan line.

Accordingly, even though the defective scan driving block is included in the scan driving device, the scan signals S[1], S[2], S[3], S[4], S[5], S[6], S[7], S[8], . . . can be sequentially outputted. That is, it is possible for the scan driving device which includes the defective scan driving block to operate normally.

The drawings and the detailed description described above are examples of the present invention, and are provided to explain the present invention, and the scope of the present invention described in the claims is not limited thereto. Therefore, it will be appreciated by those skilled in the art that various modifications are made and other equivalent embodiments are available. Accordingly, the actual scope of the present invention must be determined by the spirit of the appended claims.

What is claimed is:

1. A scan driving device, comprising:

a first scan driving block group, including a plurality of scan driving blocks, for receiving at least two different clock signals among a plurality of scan driving blocks which are sequentially arranged;

a second scan driving block group, including a plurality of scan driving blocks, for receiving at least two clock signals which are the same as at least two clock signals inputted to each of the plurality of scan driving blocks included in the first scan driving block group;

a plurality of first line transistors connected in parallel to scan lines of each of the plurality of scan driving blocks included in the first scan driving block group, said first line transistors being selectively turned on and off according to a first line connection signal; and a plurality of second line transistors connected in parallel to scan lines of each of the plurality of scan driving blocks included in the second scan driving block group, said second line transistors being selectively turned on and off according to a second line connection signal.

2. The scan driving device of claim 1, wherein a scan line of a first defective scan driving block, among the plurality of scan driving blocks included in the first scan driving block group, is disconnected and a scan signal of the first scan driving block is outputted through a first line transistor connected in parallel to the disconnected scan line.

3. The scan driving device of claim 2, wherein each of the scan driving blocks which are sequentially arranged includes an input terminal for receiving a scan signal of a scan driving block arranged ahead; and wherein an input terminal of the first scan driving block is connected to an input terminal of the second scan driving block having a same input pattern of clock signals as the first scan driving block among the plurality of scan driving blocks included in the second scan driving block group, and an output terminal of the second scan driving block is connected to an output terminal of the first scan driving block.

4. The scan driving device of claim 3, wherein the second scan driving block is a scan driving block outputting a scan signal after the first scan driving block.

5. The scan driving device of claim 3, wherein the first line connection signal is applied at a gate-off voltage which turns off the first line transistors for a period of time when the plurality of scan driving blocks included in the second scan driving block group output scan signals having a gate-on voltage.

6. The scan driving device of claim 5, wherein the first line connection signal is applied at a gate-on voltage which turns on the first line transistors for a period of time when the plurality of scan driving blocks included in the first scan driving block group output scan signals having a gate-on voltage.

7. The scan driving device of claim 3, wherein the second line connection signal is applied at a gate-off voltage which turns off the second line transistors for a period of time when the plurality of scan driving blocks included in the first scan driving block group output scan signals having a gate-on voltage.

8. The scan driving device of claim 7, wherein the second line connection signal is applied at a gate-on voltage which turns on the second line transistors for a period of time when the plurality of scan driving blocks included in the second scan driving block group output scan signals having a gate-on voltage.

9. The scan driving device of claim 1, wherein the number of the scan driving blocks included in the first scan driving block group is proportional to the number of the clock signals.

10. The scan driving device of claim 9, wherein the number of the scan driving blocks included in the second scan driving block group is the same as the number of the scan driving blocks included in the first scan driving block group.

11. A method for driving a scan driving device which includes a first scan driving block group including scan driving blocks receiving at least two different clock signals among a plurality of scan driving blocks which are sequentially arranged, and a second scan driving block group including scan driving blocks receiving at least two clock signals which are the same as at least two clock signals inputted to each of the plurality of scan driving blocks included in the first scan driving block group, the method comprising the steps of:

applying a signal, inputted to an input terminal of a first defective scan driving block among the plurality of scan driving blocks included in the first scan driving block group, to an input terminal of a second scan driving block having a same input pattern of clock signals as the first scan driving block among the plurality of scan driving blocks included in the second scan driving block group;

applying a scan signal of the second scan driving block to a scan line of the first scan driving block; and applying the scan signal of the second scan driving block to a scan line of the second scan driving block as a scan signal of a scan driving block arranged ahead of the second scan driving block is applied to an input terminal of the second scan driving block.

12. The method for driving a scan driving device of claim 11, wherein the signal inputted to the input terminal of the first scan driving block is any one of a scan start signal and a scan signal of a scan driving block arranged ahead of the first scan driving block.

13. The method for driving a scan driving device of claim 11, wherein the step of applying the scan signal of the second scan driving block to the scan line of the first scan driving block includes:

disconnecting the scan line of the first scan driving block and turning on a line transistor connected to both ends of the disconnected scan line; and applying the scan signal of the second scan driving block to the scan line of the first scan driving block through the turned-on line transistor.

14. The method for driving a scan driving device of claim 13, wherein the step of applying the scan signal of the second scan driving block to the scan line of the second scan driving block includes turning off the line transistor.

15. A method for managing a defect of a scan driving device which includes a first scan driving block group including a plurality of scan driving blocks receiving at least two different clock signals among a plurality of scan driving blocks which are sequentially arranged, and a second scan driving block group including a plurality of scan driving blocks receiving at least two clock signals which are the same as at least two clock signals inputted to each of the plurality of scan driving blocks included in the first scan driving block group, the method comprising the steps of:

connecting an input terminal of a first defective scan driving block, among the plurality of scan driving blocks included in the first scan driving block group, to an input terminal of a second scan driving block having a same input pattern of clock signals as the first scan driving block among the plurality of scan driving blocks included in the second scan driving block group;

connecting an output terminal of the second scan driving block to an output terminal of the first scan driving block; and disconnecting a scan line of the first scan driving block and connecting both ends of the disconnected scan line to both ends of a line transistor.

16. The method for managing a defect of a scan driving device of claim 15, further comprising the step of connecting a gate electrode of the line transistor to a line connection signal line transmitting a line connection signal applied at a gate-off voltage for a period of time when the scan driving blocks included in the second scan driving block group output scan signals having a gate-on voltage.

17. The method for managing a defect of a scan driving device of claim 16, wherein the line connection signal is applied at a gate-on voltage turning on the line transistor for a period of time when the scan driving blocks included in the first scan driving block group output scan signals having a gate-on voltage.

18. The method for managing a defect of a scan driving device of claim 15, wherein the second scan driving block is a scan driving block outputting a scan signal after the first scan driving block.

* * * * *